US007242297B2

(12) United States Patent
Vogt

(10) Patent No.: US 7,242,297 B2
(45) Date of Patent: Jul. 10, 2007

(54) ALARM SENSOR

(76) Inventor: William R. Vogt, 112 Jordan Rd., Rockaway, NJ (US) 07866

( * ) Notice: Subject to any disclaimer, the term of this patent is extended or adjusted under 35 U.S.C. 154(b) by 103 days.

(21) Appl. No.: 11/058,867

(22) Filed: Feb. 16, 2005

(65) Prior Publication Data

US 2006/0192676 A1 Aug. 31, 2006

(51) Int. Cl.
*G08B 13/08* (2006.01)

(52) U.S. Cl. ..... 340/547; 340/541; 340/545.1; 340/551

(58) Field of Classification Search ..... None
See application file for complete search history.

(56) References Cited

U.S. PATENT DOCUMENTS

| | | | | |
|---|---|---|---|---|
| 2,877,361 | A * | 3/1959 | Chase | 307/112 |
| 3,161,742 | A | 12/1964 | Bagno | |
| 3,187,129 | A | 6/1965 | McBrian | |
| 3,668,579 | A | 6/1972 | Harman | |
| 3,813,663 | A | 5/1974 | Perkins | |
| 4,209,777 | A * | 6/1980 | Morrison | 340/547 |
| 4,945,340 | A * | 7/1990 | Brill | 340/547 |
| 5,332,992 | A | 7/1994 | Woods | |
| 5,530,428 | A | 6/1996 | Woods | |
| 5,633,626 | A * | 5/1997 | Cawthorne | 340/545.1 |
| 5,668,533 | A * | 9/1997 | Jackson, Jr. et al. | 340/547 |
| 5,673,021 | A | 9/1997 | Woods | |
| 5,777,552 | A * | 7/1998 | Fischette et al. | 340/547 |
| 5,874,878 | A * | 2/1999 | Jackson, Jr. | 335/205 |
| 5,880,659 | A | 3/1999 | Woods | |
| 6,400,267 | B1 * | 6/2002 | Gordon-Levitt et al. | 340/547 |
| 6,453,847 | B2 * | 9/2002 | Brooks | 119/484 |
| 6,963,281 | B2 * | 11/2005 | Buckley | 340/547 |
| 7,049,914 | B2 * | 5/2006 | Lamb et al. | 335/216 |
| 2003/0015408 | A1 | 1/2003 | Woods | |
| 2003/0016106 | A1 | 1/2003 | Woods | |
| 2003/0052780 | A1 | 3/2003 | Buckley | |

* cited by examiner

*Primary Examiner*—Benjamin C. Lee
*Assistant Examiner*—Son Tang
(74) *Attorney, Agent, or Firm*—Polster, Lieder, Woodruff & Lucchesi, LC.

(57) ABSTRACT

An alarm system sensor (10) monitoring movement of an object (D) and placing the system into alarm when the object moves more than a predetermined distance from a predetermined position. First and second reed switches (16, 18) are located in a predetermined orientation relative to each other and in tandem to the object. Bias magnets (24, 26) are used with the reed switches. A magnet (20) is movable with the object and produces a force simultaneously sensed by both reed switches. This force maintains both reed switches in a state keeping the alarm system in a non-alarm condition so long as the object substantially remains in its predetermined position. The object, when it moves, moves toward one of the reed switches and away from the other reed switch. Movement of the object more than the predetermined distance results in the force sensed by one of the reed switches increasing and the force sensed by the other reed switch decreasing. Either change in sensed force activates the appropriate reed switch causing the alarm system to go into alarm.

12 Claims, 2 Drawing Sheets

ALARM SENSOR

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to sensors for monitoring the position of a door or the like; and, more particularly, to a tandem sensor for use in such monitoring and which cannot be readily defeated.

In security systems for monitoring a premises, a sensor is often used with a door or window to provide an indication when the door, for example, is open when it shouldn't be. One type of sensor used for this purpose utilizes a reed switch. As shown in FIG. 1A, a door D is monitored by a sensor S comprised of a first element E1 attached to the door and moving with the door as it opens and closes, and a second element E2 which is permanently affixed to a door frame or jamb F. In FIG. 1B, element E1 is shown to include a magnet M1 which is installed in a housing mounted on the door. Element E2 is shown to include both a magnet M2 and a reed switch RS both of which are installed in a housing mounted to the frame. When the sensor is installed, the elements E1 and E2 are positioned relative to each other so when door D is closed, the magnetic fields produced by magnets M1 and M2 cancel each other out at the location of reed switch RS and switch RS is in a null field. In this position, switch RS is deactivated as shown in FIG. 1B. When door D is opened, element E1 moves relative to element E2 and the magnitude of the magnetic fields to which switch RS is subjected change. Now, the switch is no longer in a null field, but rather, the net magnetic field to which it is subjected will cause the switch to activate. If an alarm system in which the sensor is incorporated is activated, this action will cause the system to go into alarm.

While this sensor configuration is commonly in use, it is possible, although extremely difficult, to defeat the sensor. Referring again to FIG. 1B, assuming door D opens in the direction of the arrow, if a third magnet M3 is introduced and if this third magnet is appropriately positioned as the door opens, the net magnetic field to which switch RS is subjected will remain essentially the same as that when the door is closed; i.e., a null field. In a null field, the reed switch will not activate, and the system will not go into alarm, even though door D is opened. Accordingly, the security of the premises can be breached and no one will know it while it is happening.

SUMMARY OF THE INVENTION

The invention, briefly stated, is directed to a sensor for use in an alarm system and which cannot be readily defeated by someone trying to breach a premises where the security system is installed. The sensor comprises a pair of reed switches mounted in the same housing and positioned in tandem with respect to an object (door, window, etc.,) being monitored by the sensor. Biasing magnets are installed in the housing with the reed switches. The housing in which the reed switches and biasing magnets are installed is mounted to a fixed position relative to the object. A second, or force producing magnet is installed in a separate housing which is mounted on the movable portion of the object. The positions of the reed switches, the biasing magnets, and the second magnet are adjustable so that respective reed switches are each subjected to a null field or force when the object is in a predetermined position; e.g., the door or window is closed. When the object moves, because the reed switches are in a tandem relationship with respect to the object, movement of the object is substantially toward one of the reed switches and substantially away from the other reed switch, and movement of the object more than the predetermined distance results in the force sensed by one of the reed switches increasing and the force sensed by the other reed switch decreasing. Either change in sensed force causes the alarm system to go into alarm.

Now, when someone tries to defeat the system using an additional magnet or magnets which are moved in conjunction with movement of the object, because the reed switches are arranged in tandem with respect to movement of the object, the resultant magnet fields to which at least one of the reed switches is subjected no longer is a null and the reed switch will activate, placing the system into alarm.

Other objects will be in part apparent and in part pointed out hereinafter.

BRIEF DESCRIPTION OF THE DRAWINGS

Corresponding reference characters indicate corresponding parts throughout the several views of the drawings.

DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 2A:
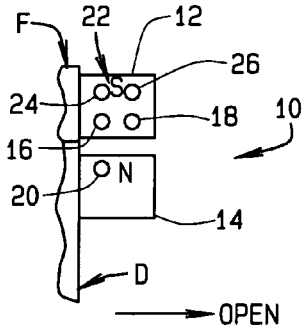
FIG. 2A is an elevation view illustrating installation of the sensor of the present invention.

Referring to FIG. 2A, a sensor 10 of the present invention includes a housing 12 mounted on door frame or jamb F, for example, and a second housing 14 mounted on a movable object such as door D. The function of sensor 10 is to monitor movement of the door and place an alarm or security system in which the sensor is installed into alarm when the door moves more than a predetermined distance from a predetermined position. Typically the predetermined position will be the door closed position. As previously discussed, this predetermined distance may, for example, correspond to the thickness of the door so the system will go into alarm prior to the door clearing the frame in which it is installed.

Figure 2B:
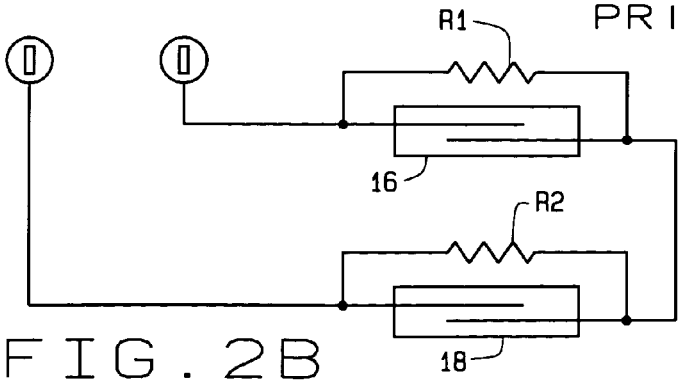
FIG. 2B is a schematic showing the connection of the reed switches in the sensor.

Sensor 10 includes a first sensing means comprising a reed switch 16, and a second sensing means comprising a reed switch 18. The reed switches are commonly mounted in housing 12. Importantly, the reed switches are located in a predetermined orientation both relative to each other and to the door. As shown in FIG. 2A, reed switch 16 is mounted in tandem with reed switch 18. This means that as door D initially moves from its closed position to an open position (as indicated by the arrow in FIG. 2A), the movement of the door will be substantially toward reed switch 18, and substantially away from reed switch 16. During installation, each reed switch is calibrated so to have both a predetermined upper limit and a predetermined lower limit with respect to which door D can move before an output from sensor 10 puts the system in an alarm condition. Both reed switches are normally deactivated as shown in FIG. 2B. However, movement of the door beyond the predetermined distance from the door closed position will result in at least one of the reed switches closing; which closure triggers an alarm state for the system. Further with respect to FIG. 2B, it will be noted that the reed switches are connected in series and that each switch has a resistor R1, R2 respectively connected in parallel with it.

Next, a force means or magnet 20 is mounted in housing 14 so to be movable with the door as it is opened and closed. Those skilled in the art will understand that while only one magnet 20 is shown as installed in housing 14, it is not uncommon to have more than one magnet installed therein to effectively create a larger, stronger magnetic source. Regardless, magnet 20 produces a magnetic field the force of which is simultaneously sensed by both reed switches. This is as shown in F*i*G. 3A.

Figure 3A:
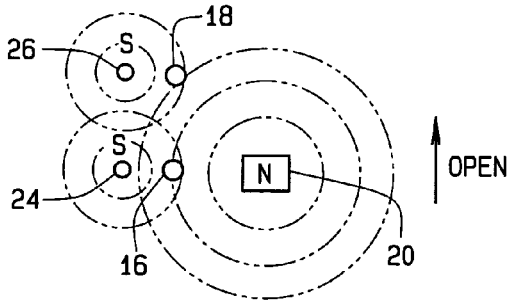
FIG. 3A is a diagram illustrating the magnetic fields to which reed switches of the sensor of the present invention are subjected as compared with that of a prior art sensor shown in FIG. 3B; and, FIG. 4 is graph illustrating the effect of movement of a door or window on the reed switches of the sensor.
Figure 3B:
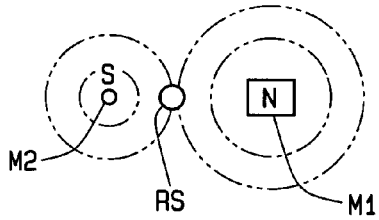
FIG. 3B PRIOR ART

Also installed in housing 12 is bias means 22 which, in conjunction with magnet 20 provides a null force acting on reed switches 16, 18 when door D is in its predetermined or closed position. Bias means 22 comprises a separate magnet, 24-26 respectively, for each reed switch. During installation of sensor 10, the magnets 24,26 are positioned within housing 12 and with respect to the reed switches so the net magnetic fields to which both reed switches are subjected when the door (with magnet 20) is in a closed, secure position, is a resulant null field. That is, in this predetermined position, there is no net force acting on either reed switch which would cause the reed switch to activate. As shown in FIG. 3A, each reed switch is subjected to a magnetic field generated by magnet 20, as well as by the bias magnets 24, 26. As also shown in FIG. 3A, this arrangement substantially differs from that of prior art sensors in which reed switch RS is only subject to the magnetic fields produced by magnets Ml and M2, as shown in FIG. 3B.

Sensor 10, once calibrated, will maintain the alarm system in a non-alarm condition so long as door D substantially remains in its predetermined position. As the door is opened, because the reed switches are in tandem, magnet 20 will start to move substantially away from reed switch 16, and substantially toward reed switch 18. This movement now starts to affect the net magnetic fields to which both reed switches are subjected. However, so long as the upper and limits of the reed switches are not exceeded, the reed switches remain deactivated and the alarm system remains in its non-alarm condition. Movement of the door more than the predetermined distance produces the following results:

With respect to the location at reed switch 16, as the door continues to open the effect of magnet 20 begins to lessen; while, that of magnet 24 remains constant. This results in an increase in the magnetic field to which reed switch 16 is subjected, due to the constant magnetic effect of magnet 24. When magnet 20 has moved sufficiently away from the location reed switch 16, the magnetic effect produced by magnet 20 will be sufficiently lessened that the continued, constant effect of magnet 24 will activate reed switch 16 putting the system into alarm.

Simultaneously, with respect to the location at reed switch 18, as the door continues to open the effect of magnet 20 begins to increase; while, that of magnet 26 remains constant. This results in an increase in the magnetic field to which reed switch 18 is subjected, due to the increased influence of magnet 20. Once the door has opened so that magnet 20 has moved sufficiently close to the location of reed switch 18, the magnetic effect produced by magnet 20 will be sufficiently increased to activate reed switch 18, putting the system into alarm.

Figure 1A:
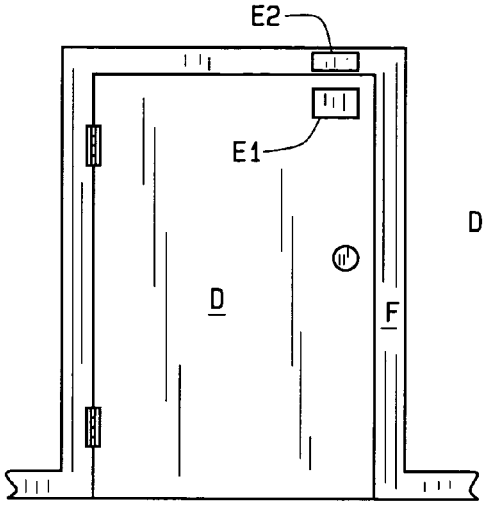
FIG. 1A PRIOR ART
FIGS. 1A and 1B are representations of a prior art reed switch sensor for a door or window or the like and how the sensor can be defeated.
Figure 1B:
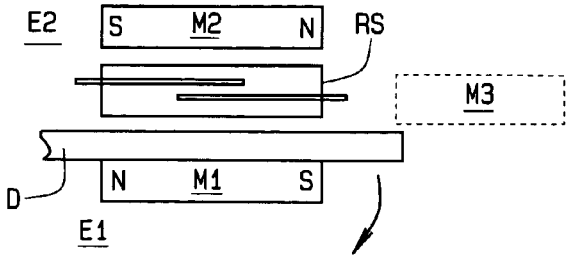
FIG. 1B PRIOR ART

The tandem arrangement of the reed switches of the present invention further makes it difficult, if not impossible, to defeat the sensor by trying to move one or more additional magnets together with movement of door D, so to be able to open the door without being detected. This is because any magnetic field generated by an additional magnet or magnets must be in the orientation of magnet 20 in order to prevent the activation of reed switch 16. However, this action only serves to increase the magnetic field at the location of reed switch 18 resulting in activation of reed switch 18 and therefore the alarm system. Accordingly, while it may be possible to compromise reed switch 16 with the introduction of another magnet (such as the magnet M3 of FIG. 1B), the tandem reed switch 18 of sensor 10 of the present invention precludes this from happening.

Figure 4:
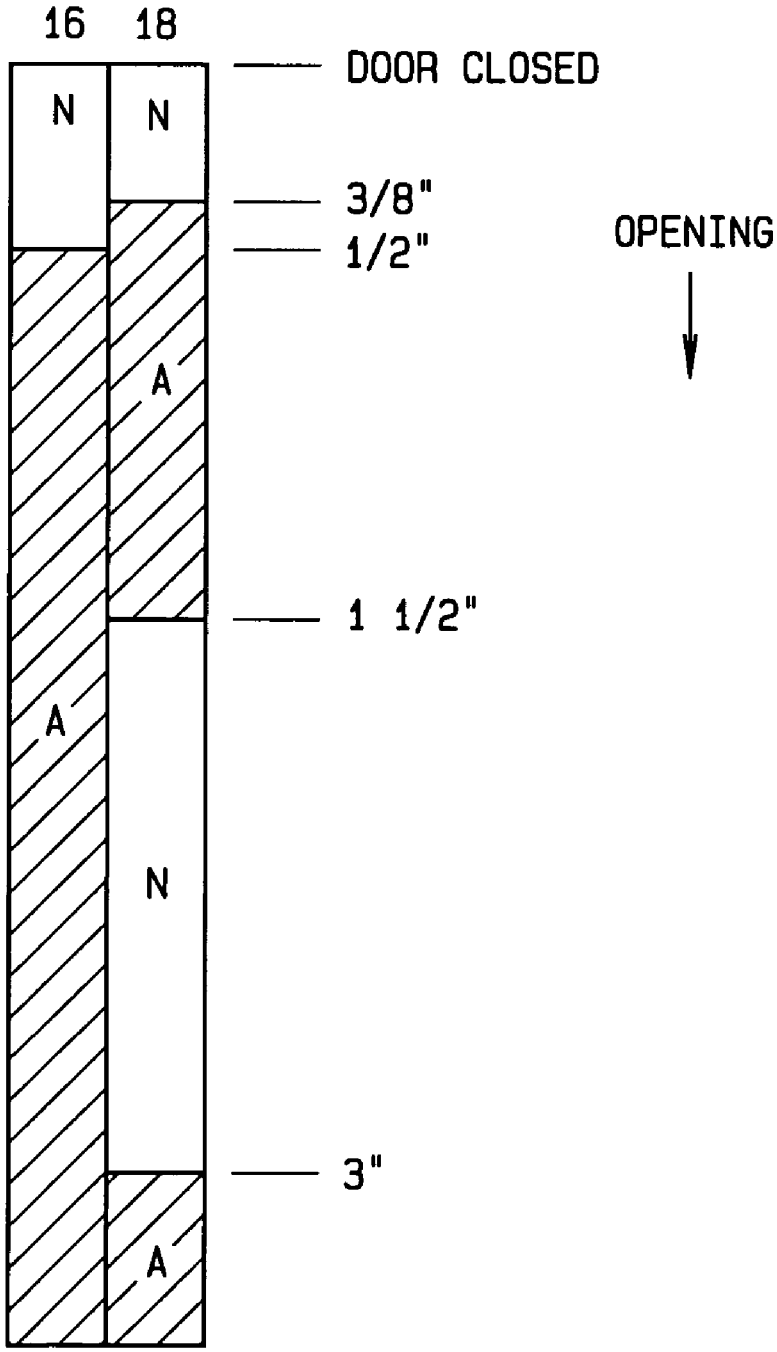

Referring to FIG. 4, a graph is presented illustrating the effect of movement of door D as it opens. As shown therein, initially both reed switches 16, 18 remain deactivated because movement of the door is within a predetermined, allowable distance which is, for example, ⅜". As the door continues to open past that distance, reed switch 18 activates and the system goes into alarm. As the door further opens, for example, when the door is approximately ½" open, reed switch 16 activates. When the door has further opened, for example, when it has opened approximately 1 11/2", reed switch 18 deactivates because the magnetic field to which it is subjected again becomes a null field. This is because magnet 20 has now moved the same distance past reed switch 18 that it was in when the door was closed. Finally, when door D is sufficiently open, for example, 3", the limit of reed switch 18 is again exceeded and both switches 16 and 18 are activated. It will be noted that once reed switch 18 is initially activated the alarm system, at all times, remains in alarm.

While the sensing means described above has been with respect to reed switches, those skilled in the art will understand that other sensing means can be employed with sensor 10 without departing from the scope of the invention. For example, a Hall-effect sensor could be used in place of one or both of the reed switches.

In view of the above, it will be seen that the several objects and advantages of the present invention have been achieved and other advantageous results have been obtained.

What is claimed is:

1. A sensor for use in an alarm system to monitor movement of an object and to place the system into alarm when the object moves more than a predetermined distance from a predetermined position comprising:

a first reed switch and a second reed switch, both reed switches being located in a predetermined orientation relative to each other and to the object;

bias means comprising a first magnet for the first reed switch and a second and separate magnet for the second reed switch; and, force means including a third magnet which is movable with the object and produces a force simultaneously sensed by both reed switches, said third magnet and said first and second magnets together producing a null field for each of said first and second reed switches when the object is in a predetermined position, and said force means maintaining both reed switches in a state which maintains the alarm system in a non-alarm condition so long as the object substantially remains in its predetermined position, but movement of the object more than the predetermined distance resulting in the force means increasing its force sensed by one of the reed switches and decreasing its force sensed by the other reed switch, either of which conditions causes the alarm system to go into alarm.

2. The sensor of claim 1 in which the first reed switch is mounted in tandem with the second reed switch relative to the movement of the object whereby when the object moves, its movement is substantially toward one of the reed switches and substantially away from the other reed switch.

3. A sensor for use in an alarm system to monitor movement of an object and to place the system into alarm when the object moves more than a predetermined distance from a predetermined position comprising:

a first reed switch and a second reed switch, both reed switches being located in a predetermined orientation relative to each other and to the object, and each reed switch having a predetermined upper and lower limit with respect to which the object can move before an output from the respective reed switch puts the system in an alarm condition;

bias means comprising a first magnet for the first reed switch and a second and separate magnet for the second reed switch; and, force means including a third magnet movable with the object and producing a force simultaneously sensed by both reed switches, said force means maintaining both reed switches in a state which maintains the alarm system in a non-alarm condition so long as the object substantially remains in its predetermined position, but movement of the object more than the predetermined distance resulting in the force means increasing its force sensed by one of the reed switches and decreasing its force sensed by the other reed switch, either of which conditions, when it exceeds at least one of the predetermined limits for the reed switches causes the alarm system to go into alarm.

4. The sensor of claim 3 in which the first reed switch is mounted in tandem with the second reed switch relative to the movement of the object, whereby when the object moves, its movement is substantially toward one of the reed switches and substantially away from the other reed switch.

5. The sensor of claim 3 in which the bias means, in conjunction with the force means produces a null force for each reed switch when the object is in its predetermined position.

6. A sensor for use in an alarm system to monitor movement of an object and to place the system into alarm when the object moves more than a predetermined distance from a predetermined position comprising:

a first reed switch and a second reed switch, both reed switches being located in a predetermined orientation relative to each other and to the object;

bias means comprising a separate magnet for each reed switch; and, a third magnet movable with the object and producing a force simultaneously sensed by both reed switches, the force produced by the third magnet maintaining both reed switches in a state which places the alarm system in a non-alarm condition so long as the object substantially remains in its predetermined position, the object, when it moves, moving substantially toward one of the reed switches and substantially away from the other reed switch, with movement of the object more than the predetermined distance resulting in the force sensed by one of the reed switches increasing and the force sensed by the other reed switch decreasing, either change in sensed force causing the alarm system to go into alarm.

7. The sensor of claim 6 in which each reed switch has a predtermined upper and lower limit with respect to which the object can move before an output from the respective reed switch puts the system in an alarm condition, and movement of the object more than the predetermined distance resulting in the third magnet increasing the force sensed by one of the reed switches and decreasing the force sensed by the other reed switch, either of which condition, when it exceeds at least one of the predetermined limits for the respective reed switch causes the alarm system to go into alarm.

8. The sensor of claim 6 in which the first reed switch is mounted in tandem with the second reed switch relative to the movement of the object.

9. The sensor of claim 8 in which the bias means, in conjunction with the third magnet produces a null force for each reed switch when the object is in its predetermined position.

10. A sensor for use in an alarm system to monitor movement of an object and to place the system into alarm when the object moves more than a predetermined distance from a predetermined position comprising:

a first sensing means and a second sensing means both of which are located in a predetermined orientation relative to each other and to the object;

bias means simultaneously acting upon both sensing means and, force means movable with the object and producing a force simultaneously sensed by both sensing means, said force means and said bias means maintaining a substantially null force on both sensing means while the objects substantially remains in its predetermined position whereby the alarm system remains in a non-alarm condition, but movement of the object more than the predetermined distance resulting in the force means simultaneously increasing its force to which one of the sensing means is subjected and decreasing its force to which the other sensing means is subjected whereby, when the resultant force to which either of the sensing means is subjected passes a preset limit for that sensing means, the sensing means causes the alarm system to go into alarm.

11. The sensor of claim 10 in which the first and second sensing means are each reed switches mounted in tandem with each other, the bias means includes a separate magnet for each reed switch, and the force means includes a third magnet.

12. The sensor of claim 11 in which the positioning of a fourth and compromising magnet adjacent the object as the object moves, and in proximity to the reed switches, so to attempt to defeat the sensor, provides sufficient force, together with the force to which the reed switches are subjected by the third magnet, as the object moves, to cause one of the reed switches to place the alarm system into alarm.

* * * * *